US005552676A

United States Patent [19]

Viljanen

[11] Patent Number: 5,552,676

[45] Date of Patent: Sep. 3, 1996

[54] CONTROL DEVICE FOR AN APPLIANCE CONSUMING ELECTRIC POWER

[75] Inventor: Teijo Viljanen, Kauniainen, Finland

[73] Assignee: Oy Helvar, Helsinki, Finland

[21] Appl. No.: 329,084

[22] Filed: Oct. 25, 1994

[30] Foreign Application Priority Data

Oct. 28, 1993 [FI] Finland ..... 934775

[51] Int. Cl.[6] ..... H05B 37/02

[52] U.S. Cl. ..... 315/151; 315/158; 315/307; 250/206

[58] Field of Search ..... 330/51, 207 P, 330/298; 315/307, 151, 156, 158, DIG. 4, DIG. 7; 250/206, 214 A, 214 AL, 214 L

[56] References Cited

U.S. PATENT DOCUMENTS 3,633,093 1/1972 Templeton ..... 330/207 P 5,038,079 8/1991 Szuba ..... 315/158

*Primary Examiner*—Robert Pascal
*Assistant Examiner*—Michael B. Shingleton
*Attorney, Agent, or Firm*—Zarley, McKee, Thomte, Voorhees, & Sease

[57] ABSTRACT

The invention relates to a control device for an appliance consuming electric power, especially for the control of lighting or heating. The control element includes a sensor element (V8) for producing a control current or voltage as a result of a light or heat flux received thereby. An amplifier element (V4-V1) boosts the control current of said sensor element (V8) to a sufficient level for controlling one or a plurality of electronic ballasts, which is e.g. a current limiter for a discharge lamp, a regulator for a filament lamp or a heating effect regulator. The electric power required by the amplifier element (V4-V1) of the control device is supplied from said ballast by means of conductors, which also serve as a control line between the control device and the ballast.

27 Claims, 2 Drawing Sheets

CONTROL DEVICE FOR AN APPLIANCE CONSUMING ELECTRIC POWER

The present invention relates to a control device for an appliance consuming electric power, especially for the control of lighting or heating, said control device including a sensor element for producing a control current or voltage as a result of an external effect, such as a light or heat flux received thereby, as well as an amplifier element for boosting the control current of the sensor element sufficiently in view of controlling one or a plurality of electronic ballasts connected between a power source and an appliance to be controlled.

Said ballast can be a discharge lamp current limiter, a filament lamp regulator, a halogen lamp regulator or voltage converter or a heating effect regulator. However, a control device of the invention can be applied to the control of all types of electric appliances responding to some external effect, such as light, heat, sound, pressure, acceleration or the like, which is capable of producing a low control current in a transducer which is dependent on the influence of said external effect.

However, a primary application of the invention is the control of lighting and, thus, the invention will be described as a lighting control device hereinbelow.

A 1–10 V analogue signal control has rapidly become popular in adjustable electronic ballasts.

The emergence of a direct control for ballasts has also led to the increased use of light control systems in an effort to stabilize the illumination level in an indoor space by means of various light sensor-amplifier systems.

Normally, this type of system operates in such a manner that the light sensor measures the illumination level of an object converting it to a voltage level which is conformed to the control standard (1–10 V) of ballasts by means of an amplifier unit. Some of the light of a controlled illuminator or lighting fixture flows back to the light sensor resulting in a feedback. The light sensors are provided with a control for setting a desired illumination level. The sensor increases or decreases the control until a desired total amount of light is produced by the lighting fixture and the light flux from outside and received by the sensor. Thus, the illumination level of a room can be stabilized at a desired level. The amplifiers are active elements and thus require a power source. In the prior art control devices, the amplifiers are separate elements provided with a power source which receives its energy normally from the mains.

An object of the invention is to provide an improved control device, wherein all of the energy required by a sensor amplifier is exceptionally drawn from the control lines of a ballast.

In view of carrying out this invention there is also developed a novel type of solution for a sensor amplifier, which (1) operates on a voltage less than 1.0 V, (2) needs very little energy to operate, and (3) is nevertheless capable of absorbing even high currents for facilitating the parallel control of a plurality of ballasts.

Figure 1:
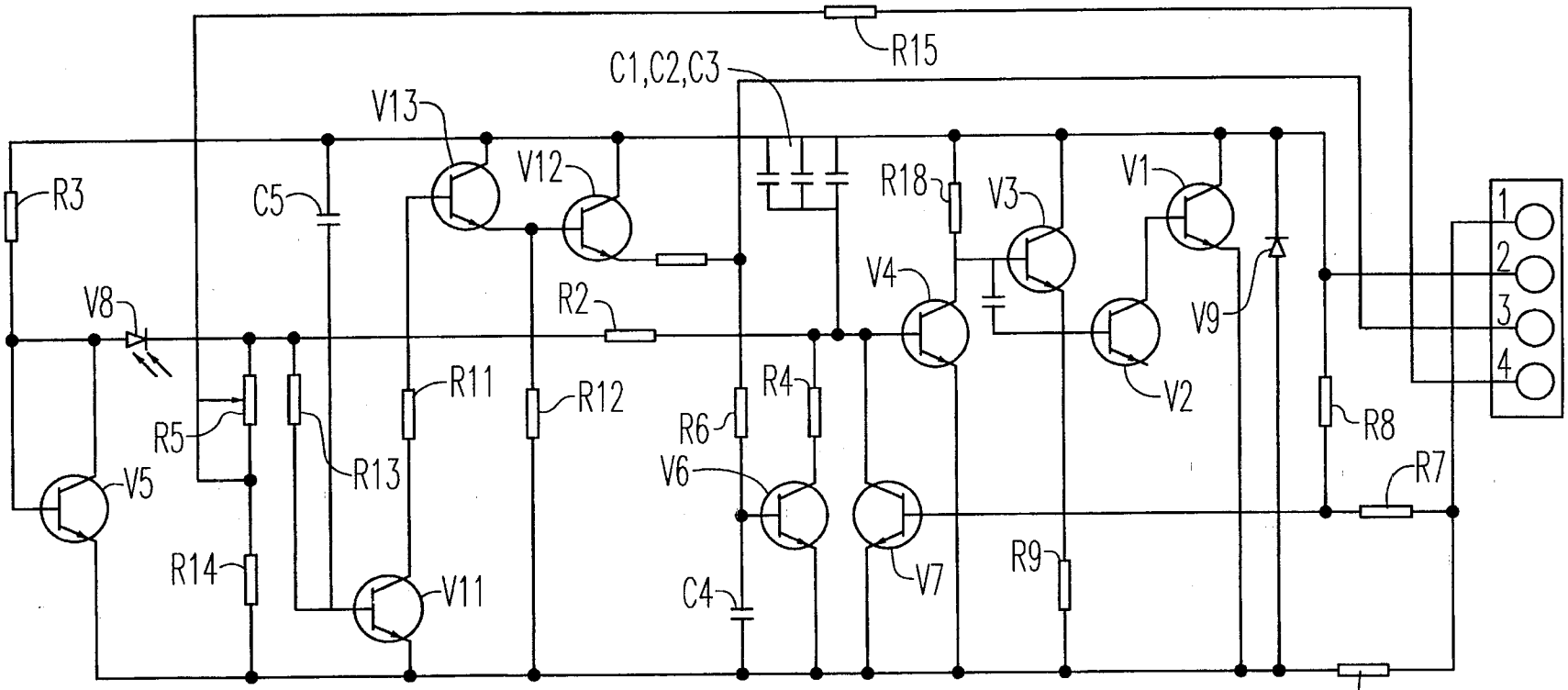
Figure 2:
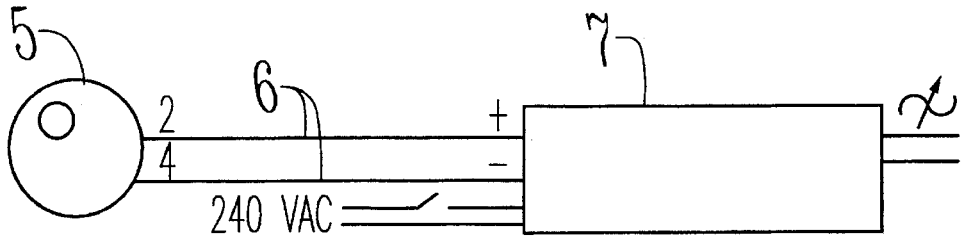
Figure 3:
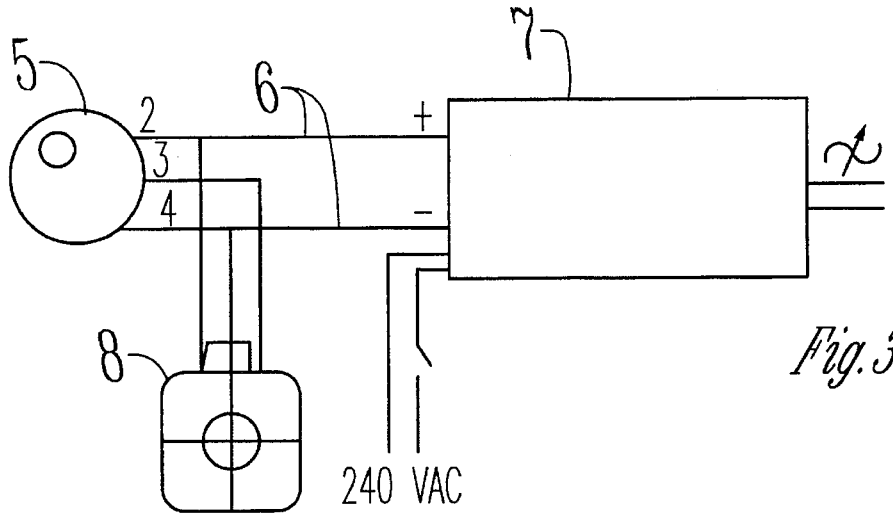
Figure 4:
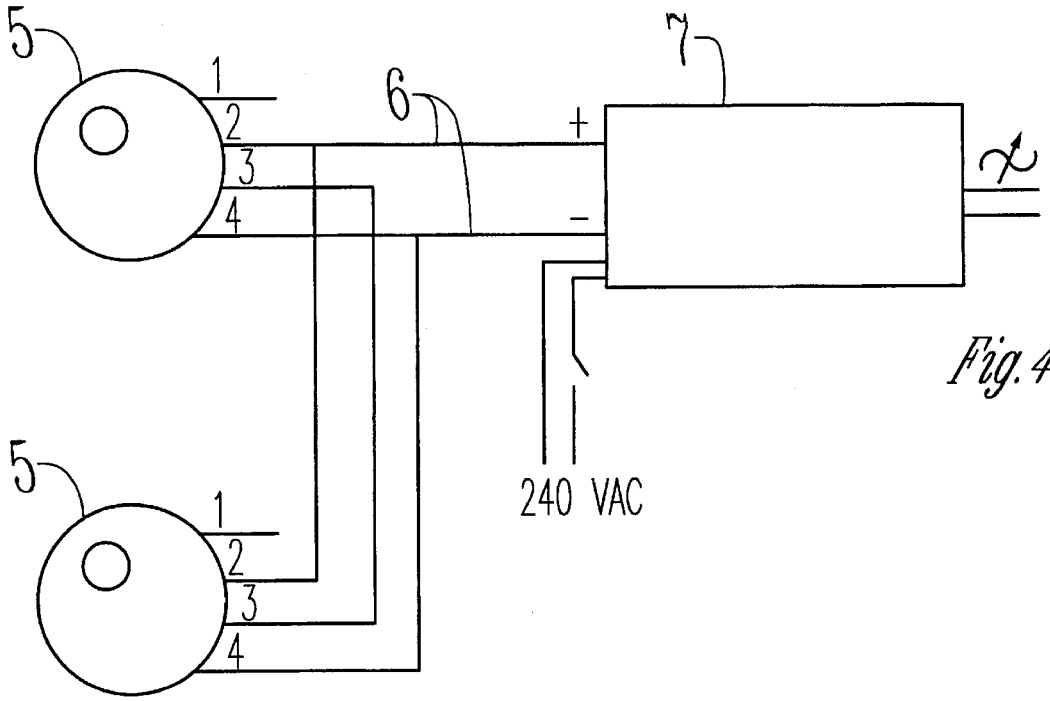

One exemplary embodiment of the invention and its various switching applications will now be described in more detail with reference made to the accompanying drawings, in which FIG. 1 illustrates a circuit diagram for a control device according to one embodiment of the invention;

FIG. 2 shows a basic connection between a control device and a ballast;

FIG. 3 is otherwise similar to FIG. 2 but the connection is further provided with a manual controller, whereby the control is optionally effected manually or with a control device of the invention or with a combination thereof such that the manual control sets an upper limit for the illumination level and serves as a main switch; and FIG. 4 shows the operation of control devices of the invention in a parallel switching mode, the control being effected according to a sensor receiving the least amount of light.

Reference is now made to,the circuit diagram shown in FIG. 1. The control device comprises functionally four different elements:

1) An amplifier/integrator element V1-V4 for boosting the micro-ampere level current of a sensor V8 to a sufficient level for controlling a desired number of ballasts 7 (in FIGS. 2–4). The amplifier element is also provided with a current limiter circuit V7, R8, R7 for protecting the amplifier from overloading.
2) A sensor element V8 and biasing and compensating elements V5, R3 directly associated therewith. Instead of an active sensor element, the control current can also be supplied by means of a passive regulating element.
3) A circuit provided by transistors V6, V11, V12, V13 and resistances R11, R12, R5, R6, R9, one of whose functions is that an external line (terminal 3) can be used for forcing the amplifier to a high-impedance condition or congestion. This facilitates the parallel switching of a plurality of control devices (see FIG. 4), such that the light sensor V8 receiving the least amount of light has a determinant position in the control system.
4) A sensitivity control element R5, R15, R14 for adjusting the sensitivity level of a control device either by means of a variable resistance R5 included in the device or by an external voltage/current delivered to a connecting terminal 1.

Operation of the Amplifier

Operation of the amplifier is based on the properties of silicon-based bipolar transistors. These have a saturation voltage Vbe less than 0.25 V even on moderate currents and the terminal has a control voltage Ube between 0.6–0.7 V. By connecting the pnp- and npn-type transistors alternately in chain there is provided a circuit, wherein the collector current of a preceding transistor is the terminal current of a following transistor, i.e. higher by the current amplification factor HFE of each transistor. With this type of configuration on a very low control current, the amplifier is capable of absorbing reasonably high currents even at a transient voltage less than a volt. The amplifier is further provided with a power protection V7, R8, R7, i.e. if a current passing through and a voltage across the amplifier are excessively high, the transistor V7 switches the amplifier to a high-ohmic state.

Sensor Element and Biasing

The light sensor used in the control device produces between its terminals a current or a voltage, which is proportional to a light flux received by the sensor. The sensor operates linearly provided that the voltage thereacross is kept very low and the current delivered thereby is measured. This is effected by biasing the amplifier input as follows: In order to pick up control current, the terminal voltage of an amplifier transistor V4 must be at least equal to the contact potential, i.e. 0.6–0.7 V (depending on temperature, current strength and transistor type). By producing an equally high voltage with another identical transistor (V5), by connecting its terminal and collector together and these by a high resistance (R3, R18) to the collector of the first transistor (V4) of the amplifier, it is possible to connect a sensor element (V8) between the terminals of these two transistors V4, V5 without a transient voltage.

Barrier Circuit for the Control Device

The control device can be brought to a high-ohmic state by means of an external control. This is effected in such a manner that the terminal voltage of the first transistor V4 of the amplifier is brought down by means of an additional transistor V7, which receives its control from an external line (line 1) or from an internal "pull-up" transistor V6, which is always in conducting state if the light received by the control device exceeds a set value. This is observed by transistors V11 and V13. Thus, the external line (terminal 3) controlling the transistor V6 is logically of a yes-type, i.e. when the control devices are connected in parallel, said control devices can only be in active state if all the control devices receive a sufficient amount of light.

Adjustment of the Sensitivity of the Control Device

Since the sensor element V8 is biased to the level of about 0.65 V, it has been possible to effect the sensitivity adjustment in a very simple manner by a mere trimmer resistance R5. Control current flows from sensor V8 to the amplifier only if in the case that it exceeds a current picked up by the regulation trimmer R5, i.e. a current which is the biasing voltage divided by the resistance at that particular moment. When the amplifier receives current, it begins to conduct and drives the control voltage to such limiting level that the sensor V8 is no longer capable of supplying the amplifier. The amplifier has been made very slow by means of time constant capacitors C1–C3 in order to avoid the oscillation of the regulating circuit.

The external sensitivity adjustment is effected by varying the voltage at the bottom end of trimmer R5 by an external voltage by means of resistances R14, R15. At the same time, this produces a change in the transient voltage of trimmer R5 and in the current picked up thereby.

The basic connection shown in FIG. 2 includes conductors 6, which provide a control line and whereby the above-described control device 5 is connected to a ballast 7 which is connected between discharge lamps and the mains voltage. The control device 5 receives electric power from the ballast 7 by way of the conductors 6 included in the control line.

In the case of FIG. 3, the control device 5 includes a terminal 3 to which is connected a control line coming from a manual controller 8. As a Consequence of the activation of the manual controller 8, the ballast follows its control. When the manual controller 8 is switched off, the control device 5 controls the ballast 7. If the control line is not connected to terminal 3, the manual controller 8 limits the maximum illumination level of a lighting fixture. At the same time, the manual controller 8 can be used as an ON/OFF-switch.

Reference has already been made to the operation of a parallel connection as shown in FIG. 4. The "disable" terminals 3 of parallel connected control devices 5 are connected by a wire, whereby the control device 5 receiving the least amount of light has the deciding position in the regulating system.

I claim:

1. A control device for an appliance consuming electric power, especially for the control of lighting or heating, said control device including a sensor element (V8) for producing a control current as a result of a sensed external effect, circuit elements (R3, V5) to provide appropriate bias-voltage to said sensor element (V8) and to compensate for the base-emitter voltage drop of transistor (V4) over the whole operating temperature range of transistor (V4) of an amplifier element (V4-V1) that boosts the control current produced by the sensor element (V8) sufficiently in view of controlling one or a plurality of electronic ballasts (7) connected between a power source and an appliance to be controlled, wherein the electric power required by the circuit elements (R3, V5) and the amplifier element (V4-V1) of said control device (5) is supplied from said ballast (7) by means of conductors (6) connected between the ballast and the control device (5), said conductors (6) also serving as a control line between the control device (5) and the ballast (7), characterized in that the sensor element (V8) and the circuit elements (R3, V5) are connected between the base and emitter electrodes of said transistor (V4) of said amplifier element (V4-V1) in order to provide the control current to the base of transistor (V4) and to compensate for the voltage drop across the base and emitter of transistor (V4) and to enable the control device to operate with a supply voltage less than 1.0 volts, said conductors (6) being connected across the collector-emitter circuit of said transistor (V4) such that most of the voltage across said conductors (6) is applied across said base-emitter circuit when said transistor (V4) is conductive.

2. A control device as set forth in claim 1, characterized in that said conductors (6) also serve as a control line between the control device (5) and the ballast (7).

3. A control device as set forth in claim 19, characterized in that said ballast (7) comprises a current limiter for a discharge lamp.

4. A control device for an appliance consuming electric power, especially for the control of lighting or heating, said control device including a sensor element (V8) for producing a control current as a result of a sensed external effect, circuit elements (R3, V5) to provide appropriate bias-voltage to said sensor element (V8) and to compensate for the base-emitter voltage drop of transistor (V4) over the whole operating temperature range of transistor (V4) of an amplifier element (V4-V1) that boosts the control current produced by the sensor element (V8) sufficiently in view of controlling one or a plurality of electronic ballasts (7) connected between a power source and an appliance to be controlled, wherein the electric power required by the circuit elements (R3, V5) and the amplifier element (V4-V1) of said control device (5) is supplied from said ballast (7) by means of conductors (6) connected between the ballast and the control device (5), said conductors (6) also serving as a control line between the control device (5) and the ballast (7), characterized in that the sensor element (V8) and the circuit elements (R3, V5) are connected between the base and emitter electrodes of said transistor (V4) of said amplifier element (V4-V1) in order to provide the control current to the base of transistor (V4) and to compensate for the voltage drop across the base and emitter of transistor (V4) and to enable the control device to operate with a supply voltage less than 1.0 volts, said conductors (6) being connected across the collector-emitter circuit of said transistor (V4) such that most of the voltage across said conductors (6) is applied across said base-emitter circuit when said transistor (V4) is conductive, wherein the controls device (5) is provided with an external control line (3) connected to the amplifier element (V4-V1) in such a manner that, when a plurality of control devices (5) are connected in parallel and the external control line (3) of each of the plurality of control devices (5) are connected together, the only active control device (5) is the one receiving the least amount of the sensed external effect.

5. A control device as set forth in any of claim 1, characterized in that the amplifier element (V4-V1) includes pnp- and npn-transistors (V4-V1), which are connected alternately in chain in such a manner that the collector current of a preceding transistor is the terminal current of a following transistor.

6. A control device as set forth in any of claims 1, characterized in that the sensor element (V8) is biased (V5, R3) to a level of less than 1.0 V and the sensitivity adjustment of the control device is effected by means of a trimmer resistance (R5).

7. A control device as set forth in any of claims 1, characterized in that the amplifier element (V4-V1) is provided with a power limiting circuit (V7, R8, R7) which brings the amplifier to a high-ohmic state if the output power of the amplifier becomes too high.

8. A control device as set forth in claim 1, characterized in that a control output (2) included in the amplifier (V4-V1), through which the amplifier receives its operating power, is connected to a biasing element (V5) and prevents the supply of a control current from the sensor to the amplifier as the output level of said amplifier reaches a certain level.

9. A control device as set forth in claim 1 characterized in that upstream of the amplifier (V4-V1) is connected a transistor (V6), which is always in a conducting state whenever the sensor receives more light than a set value, and a second amplifier (V11-V13) for controlling said transistor (V6) is connected between the sensor (V8) and the amplifier element (V4-V1).

10. A control device as set forth in claim 1 characterized in that the sensor (V8) is connected between the terminals of the circuit elements (R3, V5) and transistor (V4) of the amplifier element.

11. A control device as set forth in claim 2 characterized in that said ballast (7) comprises a current limiter for a discharge lamp.

12. A control device as set forth in claim 11 characterized in that the control device (5) is provided with an external control line (3) connected to the amplifier element (V4-V1) in such a manner that, when a plurality of control devices (5) are connected in parallel and the external control line (3) of each of the plurality of control devices (5) are connected together, the only active control device (5) is the one receiving the leas amount of the sensed external effect.

13. A control device as set forth in claim 12 characterized in that the amplifier element (V4-V1) includes pnp- and npn-transistors (V4-V1), which are connected alternately in chain in such a manner that the collector current of a preceding transistor is the terminal current of the following transistor.

14. A control device as set forth in claim 13 characterized in that the sensor element (V8) is biased (V5, R3) to a level of less than 1.0 V and the sensitivity adjustment of the control device is effected by means of a trimmer resistance (R5).

15. A control device as set forth in claim 14 characterized in that the amplifier element (V4-V1) is provided with a power limiting circuit (V7, R8, R7) which brings the amplifier to a high-ohmic state if the output power of the amplifier becomes too high.

16. A control device as set forth in claim 15 characterized in that a control output (2) included in the amplifier (V4-V1), through which the amplifier receives its operating power, is connected to a biasing element (V5) and prevents the supply of a control current from the sensor to the amplifier as the output level of said amplifier reaches a certain level.

17. A control device as set forth in claim 16 characterized in that upstream of the amplifier (V4-V1) is connected a transistor (V6), which is always in a conducting state whenever the sensor receives more light than a set value, the verification of which is effected by connecting between the sensor (V8) and the amplifier element (V4-V1) a second amplifier (V11-V13) for controlling said transistor (V6).

18. A control device as set forth in claim 17 characterized in that the sensor (V8) is connected between the terminals of the circuit elements (R3, V5) and transistor (V4) of the amplifier element.

19. A control device as set forth in claim 1, characterized in that the amplifier element (V4-V1) includes pnp- and npn-transistors (V4-V1), which are connected alternately in chain in such a manner that the collector current of a proceeding transistor is the terminal current of a following transistor.

20. A control device as set forth in claim 1, characterized in that the sensor element (V8) is biased (V5, R3) to a level of less than 1.0 V and the sensitivity adjustment of the control device is effected by means of a trimmer resistance (R5).

21. A control device as set forth in claim 1, characterized in that the amplifier element (V4-V1) is provided with a power limiting circuit (V7, R8, R7) which brings the amplifier to a high-ohmic state if the output power of the amplifier becomes too high.

22. A control device as set forth in claim 1, characterized in that a control output (2) included in the amplifier (V4-V1), through which the amplifier receives its operating power, is connected to a biasing element (V5) and prevents the supply of a control current from the sensor to the amplifier as the output level of said amplifier reaches a certain level.

23. A control device as set forth in claim 1, characterized in that upstream of the amplifier (V4-V1) is connected a transistor (V6), which is always in a conducting state whenever the sensor receives more light than a set value, and a second amplifier (V11-V13) for controlling said transistor (V6) is connected between the sensor (V8) and the amplifier element (V4-V1).

24. A control device as set forth in claim 1 characterized in that the sensor (V8) is connected between the terminals of the circuit elements (R3, V5) and transistor (V4) of the amplifier element.

25. A control device as set forth in claim 1 characterized in that said ballast (7) comprises a regulator for a filament lamp.

26. A control device as set forth in claim 1 characterized in that said ballast (7) comprises a voltage converter for a halogen lamp.

27. A control device as set forth in claim 1 characterized in that said ballast (7) comprises a heating effect regulator.

* * * * *